United States Patent [19]

Honjo

[11] Patent Number: 4,837,536

[45] Date of Patent: Jun. 6, 1989

[54] MONOLITHIC MICROWAVE INTEGRATED CIRCUIT DEVICE USING HIGH TEMPERATURE SUPERCONDUCTIVE MATERIAL

[75] Inventor: Kazuhiko Honjo, Tokyo, Japan

[73] Assignee: NEC Corporation, Tokyo, Japan

[21] Appl. No.: 223,525

[22] Filed: Jul. 25, 1988

[30] Foreign Application Priority Data

Jul. 30, 1987 [JP] Japan ..... 62-191798

[51] Int. Cl.[4] ..... H01P 3/08

[52] U.S. Cl. ..... 333/247; 333/99 S; 357/51; 505/1; 505/866; 330/277; 330/286; 307/306

[58] Field of Search ..... 333/247, 99 S, 246; 307/306; 505/1, 866; 357/51; 330/277, 286

[56] References Cited

U.S. PATENT DOCUMENTS 3,191,055 6/1965 Swihart et al. ..... 333/99 S X 4,423,430 12/1983 Hasuo et al. ..... 307/306 X

*Primary Examiner*—Paul Gensler

*Attorney, Agent, or Firm*—Helfgott & Karas

[57] ABSTRACT

For reduction in occupation area, there is disclosed a microwave device fabricated on a semi-insulating substrate and comprising a passive component area where a plurality of passive component elements are formed and an active component area where at least one active element is formed, the passive component area having a film overlain by a dielectric film and a strip conductor extending on the dielectric film, wherein the film and the strip conductor are formed by a superconductive material, so that the dielectric material is decreased in thickness by virtue of the strip conductor of the superconductive material.

12 Claims, 3 Drawing Sheets

PRIOR-ART

PRIOR-ART

MONOLITHIC MICROWAVE INTEGRATED CIRCUIT DEVICE USING HIGH TEMPERATURE SUPERCONDUCTIVE MATERIAL

FIELD OF THE INVENTION

This invention relates to a microwave device and, more particularly, to a micro-strip line incorporated in a monolithic microwave integrated circuit device.

BACKGROUND OF THE INVENTION

Growing research and development efforts are being made for an ultra high frequency device with an emphasis put on monolithic microwave integrated circuit device which comprises passive elements such as a distributed parameter circuit, a lumped-parameter inductor, a capacitor and a resistor formed on a semi insulating substrate of, for example, gallium arsenide and active elements such as bipolar transistors or field effect transistors each having an active layer formed by using an ion implantation technique, a molecular beam epitaxial technique or a metal organic vapor phase epitaxial growth technique. A typical example of the monolithic microwave integrated circuit device is disclosed in IEEE TRANSACTIONS ON MICROWAVE THEORY AND TECHNIQUES, vol. MTT-33, No. 11, November 1985, pages 1231 to 1235. Description is hereinunder made for a three-stage amplifier circuit forming part of the monolithic microwave integrated device with reference to FIGS. 1 and 2 of the drawings.

Referring first to FIG. 1, there is shown the three-stage amplifier circuit accompanied with an input node 1 and an output node 2. The three-stage amplifier circuit comprises micro-strip lines 3 and 4 one of which is coupled at one end thereof to the input node 1 and at the other end thereof to a capacitor 5 and the other of which is coupled at one end thereof to the input node 1 and at the other end thereof to a gate electrode of a field effect transistor 6. The capacitor 5 in turn is coupled at the other electrode thereof to a ground pad 7. The field effect transistor 6 is coupled between the ground pad and a micro-strip line 8 which is coupled in parallel to a capacitor 9 and a series combination of a micro-strip line 10 and a capacitor 11. The capacitor 9 is coupled at the other electrode thereof to a gate electrode of a field effect transistor, and the series combination of the micro-strip line 10 and the capacitor 11 is coupled at the other end thereof to the ground pad 7. Thus, a circuit 13 is constituted by the field effect transistor 6, the micro-strip lines 8 and 10 and the capacitors 9 and 11, and each circuit 14 or 15 is similar in circuit arrangement to the circuit 13, so that component elements of each circuit 14 or 15 are denoted by like reference numerals designating the corresponding component elements of the circuit 13 without description.

The three-stage amplifier circuit shown in FIG. 1 is fabricated on a semi-insulating substrate 16 of gallium arsenide, and the layout thereof is illustrated in FIG. 2. The three-stage FET amplifier is operable at a frequency of the order of 12 GHz. The three-stage amplifier circuit occupies an area measuring about 1.5 millimeter×about 1.7 milli-meter, and the chip is 150 microns in thickness. Each of the micro-strip line is provided with a conductive strip formed of gold and has a width W equal to or greater than about 50 microns. Though not shown in the drawings, the reverse surface of the chip is covered with gold.

However, a problem is encountered in the prior-art microwave integrated circuit device in large occupation areas. This is because of the fact that the micro-strip lines occupy a large amount of area on the substrate in comparison with the active component elements such as field effect transistors. The reasons why the micro-strip lines consume a large amount of area are as follows.

First, it is impossible to reduce each micro-strip line in width to a value less than 50 microns in consideration of the transmission loss of signal. Second, it is necessary for each micro-strip line having a characteristic impedance ranging between 50 ohms and 100 ohms to select the thickness of the semi-insulating substrate 16 of about 150 microns if the semi-insulating substrate 16 is formed of a gallium arsenide with a dielectric constant of the order of 12. In this situation, each micro-strip should be spaced apart from the adjacent micro-strip line by a distance three times greater than the thickness of the semi-insulating substrate 16 for preventing these adjacent micro-strip lines from capacitive coupling. Then, each micro-strip line is arranged to be spaced from the adjacent micro-strip line by at least 450 microns. Finally, if the component element is scaled down in thickness of a dielectric material and in width of the micro-strip line, the characteristic impedance and the propagation constant ( which is assumed to be negligible ) are not affected by the scaling down. This means that each microstrip line is reduced in width but the length of each micro-strip line is unchanged as a result of the scaling down. Thus, the micro-strip lines occupy a large amount of area, and the occupation area is hardly reduced by the prior-art method.

SUMMARY OF THE INVENTION

It is therefore an important object of the present invention to provide a microwave device fabricated on a small chip.

To accomplish these objects, the present invention proposes to employ a superconductive material for the micro-strip lines.

In accordance with one aspect of the present invention, there is provided a microwave device fabricated on a semi-insulating substrate and comprising a passive component area where a plurality of passive component elements are formed and an active component area where at least one active element is formed, the passive component area having a film overlain by a dielectric film and a strip conductor extending on the dielectric film, wherein the film and the strip conductor are formed of a superconductive material.

In accordance with another aspect of the invention, there is disclosed a microwave device fabricated on a semi-insulating gallium arsenide substrate and comprising a plurality of passive component areas each formed with a plurality of passive component elements and an active component area formed with at least one active element, the passive component area having a film overlain by a dielectric film, a strip conductor extending on the dielectric film and a capacitor electrode formed on the dielectric film, wherein the film and the strip conductor are formed of a superconductive material.

BRIEF DESCRIPTION OF THE DRAWINGS

The features and advantages of a microwave device according to the present invention will be more clearly understood from the following description taken in conjunction with the accompanying drawings in which.

DESCRIPTION OF THE PREFERRED EMBODIMENT

Figure 1:
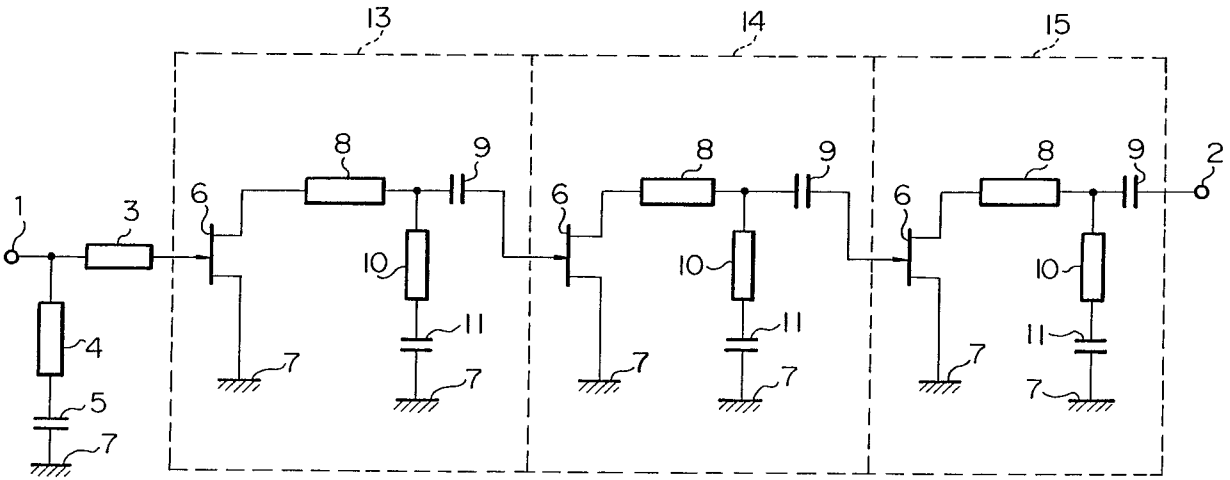
FIG. 1 is a diagram showing the circuit arrangement of a prior-art microwave device.
Figure 3:
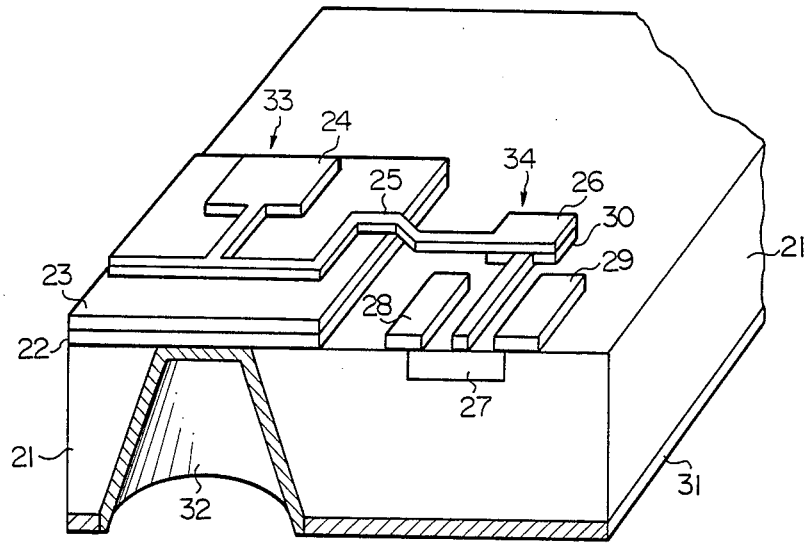
FIG. 3 is a partially cut-away perspective view showing the structure of a microwave device embodying the present invention.

Referring to FIG. 3, there is illustrated an essential part of the structure of a microwave device embodying the present invention. The equivalent circuit of the microwave device is similar to that shown in FIG. 1, so that detailed description will be omitted. The microwave device is fabricated on a semi-insulating substrate 21 of gallium-arsenide which is partially covered with a thin film 22 of a superconductive material. The thin film 22 is overlain by a dielectric film 23 which is essentially composed of a titanium oxide and a barium oxide and has a dielectric constant of about 40. On the dielectric film 23 is formed a capacitor electrode 24 and a superconductive strip 25 which are merged into each other. The superconductive strip 25 provides a micro-strip line. The superconductive strip 25 extends beyond the edge of the dielectric film 23 and is merged into a contact electrode 26. In a surface portion of the semi-insulating substrate 21 is implanted n-type impurity atoms to form an n-type semiconductor region 27 which contacts at the both side portions to source and drain electrodes 28 and 29. A gate electrode 30 is located between the source and drain regions 28 and 29 and in contact with the contact electrode 26. On the opposite surface of the semi-insulating substrate 21 is formed a back electrode 31 which is electrically connected to the thin film 22 through a via hole 32. The back electrode 31 is grounded, so that the thin film 22 is also grounded through the via hole 32. This results in reduction in electrical path by virtue of the via hole 32. The thin film 22, the dielectric film 23 and the capacitor electrode 24 as a whole constitute a capacitor 33, and the n-type semiconductor region 27, the source and drain electrodes 28 and 29 and the gate electrode 30 as a whole constitute a field effect transistor 34. In this instance, the capacitor electrode 24 and the thin film 25 are formed of a superconductive material represented by a molecular formula of $YBa_2Cu_3O_7$, and the superconductive material has a critical temperature of about 90 degrees in Kelvin. However another superconductive material is available, and one of the superconductive materials available is represented by a molecular formula of $BiCaSrCu_2O_x$.

In this instance, the superconductive strip 25 is formed on the dielectric film 23 as described above, the characteristic impedance Zo is represented by the following formula $$Zo = (Zs/Kf)(1/\sqrt{\epsilon s})(h/W)[1 + (\lambda_1/h)\coth(t_1/\lambda_1) + (\lambda_2/h)\coth(t_2/\lambda_2)]^{\frac{1}{2}} \quad (1)$$

where Zs is the wave impedance in vacuum represented by $\sqrt{\mu_0/\epsilon_0}$, $\epsilon_s$ is the dielectric constant of the dielectric material used for the dielectric film 23, h is the thickness of the dielectric film 23, W is the width of the superconductive strip 25, $\lambda_1$ and $\lambda_2$ are respective London's penetration depths of the superconductive strip 25 and the thin film 22 of the superconductive material, $t_1$ and $t_2$ are the respective thicknesses of the superconductive strip 25 and the thin film 22, and Kf is the fringing coefficient used for amendment of the edge effect.

The formula (1) teaches us that the superconductive strip can be decreased in width if the dielectric film 23 is reduced in thickness. For example, if the dielectric film 23 has a thickness ranging between 1000 angstroms and 10000 angstroms, the characteristic impedance Zo has an acceptable value between 50 ohms and 100 ohms even if the superconductive strip 25 is reduced in width. As described above, each superconductive strip 25 should be spaced apart from an adjacent superconductive strip by a distance three times greater than the thickness of the dielectric film 23. Then, it is sufficient for the superconductive strip 25 to be spaced apart from the adjacent superconductive strip by a distance ranging between 3000 angstroms and 30,000 angstroms. This results in reduction of occupation area. In addition, the propagation loss is negligible even if the superconductive strip 25 is reduced in width because of the superconductivity.

Similarly, the velocity of propagation v is represented by the following formula $$v = (c/\sqrt{\epsilon s})[1 + (\lambda_1/h)\coth(t_1/\lambda_1) + (\lambda_2/h)\coth(t_2/\lambda_2)]^{-\frac{1}{2}} \quad (2)$$

where c is the speed of light in vacuum.

As will be understood from the above formula, the velocity of propagation v and, accordingly, the wavelength of the signal on the superconductive strip 25 are decreased if a dielectric material has a larger dielectric constant $\epsilon_s$. This means that the superconductive material can be decreased in length and, for this reason, the occupation area can be reduced by virtue of reduction in length of the superconductive strip 25. Moreover, the capacitor electrode 24 is reduced in area, which also results in reduction in chip size. The superconductive strip 25 decreases 44 per cent in length in comparison with the prior-art micro-strip line using gallium arsenide with the dielectric constant of 12.7.

Figure 2:
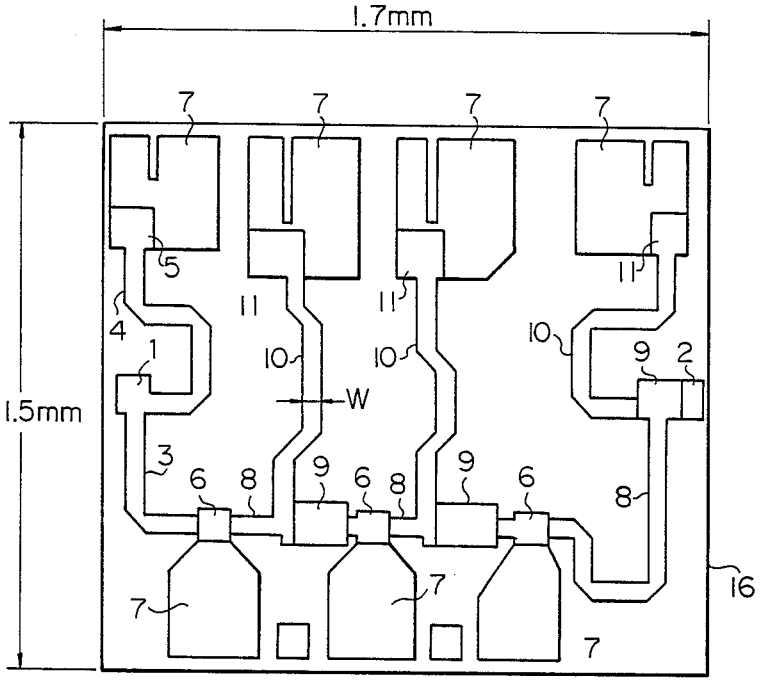
FIG. 2 is a plan view showing the layout of the circuit arrangement shown in FIG. 1.
Figure 4:
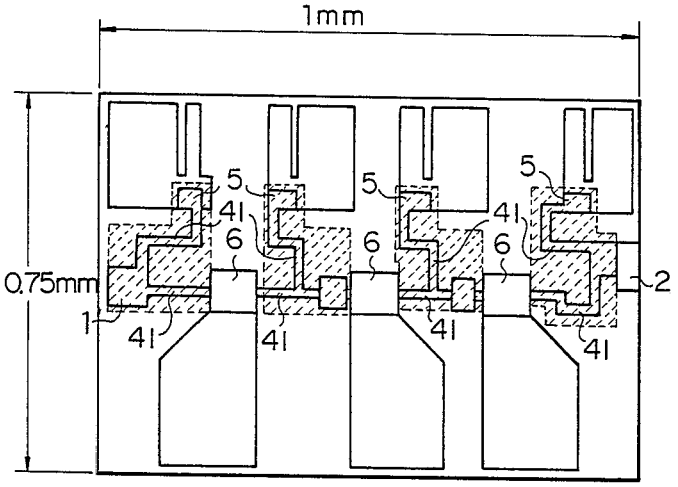
FIG. 4 is a plan view showing the layout of the circuit arrangement of the microwave device shown in FIG. 3.

Turning to FIG. 4 of the drawings, a layout of the circuit arrangement of the microwave device is illustrated. The equivalent circuit is similar to that shown in FIG. 1, so that component parts are denoted by like reference numerals designating the corresponding parts of the layout shown in FIG. 2. In FIG. 4, the multilayer structure of the thin film 22 and the dielectric film 23 are indicated by oblique dash lines, and the superconductive strips are designated by reference numeral 41 and has a width ranging between 1 micron and 5 microns. The microwave device shown in FIG. 4 merely occupies an area measuring about 0.75 milli-meter × 1 milli-meter which is one fourth of the occupation area of the prior-art microwave device.

Although particular embodiment of the present invention have been shown and described, it will be obvious to those skilled in the art that various changes and modifications may be made without departing from the spirit and scope of the present invention.

What is claimed is:

1. A microwave device fabricated on a semi-insulating substrate and comprising a passive component area where a plurality of passive component elements are formed and an active component area where at least one active element is formed, said passive component area having a film overlain by a dielectric film and a strip conductor extending on said dielectric film, wherein said film and said strip conductor are formed of a superconductive material.

2. A microwave device as set forth in claim 1, in which said superconductive material is represented by a molecular formula of $YBa_2Cu_3O_7$.

3. A microwave device as set forth in claim 2, in which said strip conductor has a width ranging between about 1 micron and about 5 microns.

4. A microwave device as set forth in claim 1, in which said dielectric film is formed of a dielectric material having a dielectric constant equal to or larger than 40.

5. A microwave device as set forth in claim 4, in which said dielectric material is composed of a titanium oxide and a barium oxide.

6. A microwave device as set forth in claim 1, in which said passive element area further has a capacitor electrode formed on said dielectric film.

7. A microwave device as set forth in claim 6, in which said semi-insulating substrate is formed of gallium arsenide.

8. A microwave device as set forth in claim 7, in which said active component element is a field effect transistor having an active region formed in said semi-insulating substrate, source and drain regions formed on the semi-insulating substrate in such a manner as to be in contact with the active region, and a gate electrode formed between the source and drain regions.

9. A microwave device as set forth in claim 8, in which said active region is an n-type semiconductor region.

10. A microwave device fabricated on a semi-insulating gallium arsenide substrate and comprising a plurality of passive component areas each formed with a plurality of passive component elements and an active component area formed with at least one active element, said passive component area having a film overlain by a dielectric film, two strip conductors extending on said dielectric film and a capacitor electrode formed on said dielectric film, wherein said film and said strip conductors are formed of a superconductive material.

11. A microwave device as set forth in claim 10, in which said active component element of one active component area is a field effect transistor coupled at one end thereof to a ground terminal and at the other end thereof to an intermediate node, wherein said passive component elements have two micro-strip lines respectively formed with said strip conductors coupled in series between the ground terminal and the intermediate node and a capacitor coupled between the intermediate node and an output node, said output node being coupled to a gate electrode of a field effect transistor of another active component area.

12. A microwave device as set forth in claim 11, in which said microwave device further comprises additional passive component area provided with a series combination of a first micro-strip line with a strip conductor of said superconductive material and a capacitor coupled between an input terminal and said ground terminal and a second micro-strip line with a strip conductor of the superconductive material coupled between the input terminal and a gate electrode of a field effect transistor of said one active component area.

* * * * *